US007141301B2

(12) United States Patent
Sakamoto et al.

(10) Patent No.: US 7,141,301 B2
(45) Date of Patent: Nov. 28, 2006

(54) HIGH STRENGTH POLYETHYLENE FIBER

(75) Inventors: Godo Sakamoto, Otsu (JP); Tooru Kitagawa, Otsu (JP); Syoji Oda, Otsu (JP); Yasuo Ohta, Otsu (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 0 days.

(21) Appl. No.: 11/106,659

(22) Filed: Apr. 15, 2005

(65) Prior Publication Data

US 2005/0238875 A1 Oct. 27, 2005

Related U.S. Application Data

(62) Division of application No. 10/450,159, filed as application No. PCT/JP01/10754 on Dec. 7, 2001, now Pat. No. 6,899,950.

(30) Foreign Application Priority Data

Dec. 11, 2000 (JP) ..... 2000-376390
Dec. 20, 2000 (JP) ..... 2000-387652

(51) Int. Cl.
*D01F 6/00* (2006.01)

(52) U.S. Cl. ..... 428/364; 428/394

(58) Field of Classification Search ..... 428/364, 428/394

See application file for complete search history.

(56) References Cited

U.S. PATENT DOCUMENTS 4,228,118 A 10/1980 Wu et al.
5,443,904 A 8/1995 Ohta et al.
5,474,845 A 12/1995 Turunen et al.
6,605,348 B1 8/2003 Ohta et al.
6,770,362 B1 8/2004 Okano
6,770,363 B1 * 8/2004 Ohta et al. ..... 428/357
6,958,187 B1 * 10/2005 Ohta et al. ..... 428/364

FOREIGN PATENT DOCUMENTS

| | | |
|---|---|---|
| CA | 1152272 | 8/1983 |
| JP | B-60-047922 | 10/1985 |
| JP | 61102412 | 5/1986 |
| JP | B-64-008732 | 2/1989 |
| JP | 3-14680 | 1/1991 |
| JP | 8-504891 A | 5/1996 |
| JP | 8-512002 A | 12/1996 |
| JP | 3034934 | 2/2000 |
| WO | WO 93/24686 | 12/1993 |
| WO | WO 95/01250 A1 | 1/1995 |
| WO | WO-0046436 | 8/2000 |

OTHER PUBLICATIONS

Supplementary European Search Report dated Apr. 14, 2005.

* cited by examiner

*Primary Examiner*—N. Edwards
(74) *Attorney, Agent, or Firm*—Morrison & Foerster LLP

(57) ABSTRACT

A high strength polyethylene filament, wherein said filament has a fineness of 1.5 dtex or less as a monofilament, a tensile strength of 15 cN/dtex or more and a tensile elastic modulus of 300 cN/dtex or more, and, the rate of dispersion-defective fibers cut from the filament is 2% or less, is disclosed, and a high strength polyethylene filament, wherein said filament has a tensile strength of 15 cN/dtex or more and a tensile elastic modulus of 300 cN/dtex or more, and, a long period structure of 100 Å or less is observed in an X-ray small angle scattering pattern is disclosed.

4 Claims, 1 Drawing Sheet

HIGH STRENGTH POLYETHYLENE FIBER

TECHNICAL FIELD

The present invention relates to a novel polyethylene filament with high strength which can be applied to a wide range of industrial fields such as high performance textiles for a variety of sports clothes, bulletproof or protective clothing, protective gloves, and a variety of safety goods; a variety of ropes (tug rope, mooring rope, yacht rope, building rope, etc.); fishing threads; braided ropes (e.g., blind cable, etc.); nets (e.g., fishing nets, ground nets, etc.); reinforcing materials for chemical filters, battery separators and non-woven cloths; canvas for tents; sports goods (e.g., helmets, skis, etc.); radio cones; composites (e.g., prepreg, etc.); and reinforcing fibers for concrete, mortar, etc.

BACKGROUND ART

As a polyethylene filament with high strength, there is known a filament which is produced from an ultra-high molecular weight polyethylene by a so-called gel-spinning method and which has such a high strength and such a high elastic modulus that any of conventional filaments has never possessed, as disclosed in JP-B-60-47922, and this filament has already come into industrially wide use. This high strength polyethylene filament has advantages in its high strength and high elastic modulus. However, the high elastic modulus thereof sometimes induces disadvantages in various applications. For example, in case where the high strength polyethylene filament is used for ordinal cloth, the resultant cloth is very stiff to the touch and thus very unsuitable in view of fitness to one's body. In case where the high strength polyethylene filament is used for a bulletproof vest, it is demanded that the bulletproof vest should be made of a plurality of pieces of cloth superposed on one another so as to confront dangers which recently have been escalated more and more. As a result, the thickness of the cloth composing the vest is increased, so that one can not freely move in such a vest.

Under such circumstances, a filament which has a lower mass (METSUKE) and a very high strength is demanded.

In the meantime, a variety of olefin-based filaments and films recently have been used for separators for various batteries. In case where high strength polyethylene filaments are used as non-woven cloth or reinforcing materials for such separators, the high strength polyethylene filaments to be used are required to have such properties that can provide non-woven cloth with thin mass (METSUKE) and concurrently with a high strength maintained, in order to meet a demand for further compacting batteries.

JP-B-64-8732 discloses a filament which is made from an ultra-high molecular weight polyethylene as a starting material by so-called "gel spinning method" and which has a lower fineness, a higher strength and a higher elastic modulus than any of conventional filaments. However, the above production of the high strength polyethylene filament with a lower fineness by the gel spinning method uses a solvent, and the use of a solvent has a disadvantage of causing fusion of the filaments. Particularly in case where a very fine filament is desired, the drawing tension tends to increase with an increased spinning tension, which induces the fusion of filaments.

Japanese Patent No. 3034934 discloses a high strength polyethylene filament having a fineness of 16.7 dtex or less as a monofilament, which is produced by drawing a high molecular weight polyethylene having a weight-average molecular weight of 600,000 to 1,500,000. The fineness of the monofilament achieved in this patent is 2.4 dtex at least, and a high strength polyethylene filament having a fineness of 1.5 dtex or less which the present invention has achieved can not be obtained.

A high strength polyethylene filament produced by melt spinning is disclosed in, for example, U.S. Pat. No. 4,228,118. According to this patent, the high strength polyethylene filament disclosed has a strength of 17.1 cN/dtex, an elastic modulus of 754 cN/dtex, and a finness of 2.0 dtex at least as a monofilament of the fiber. Thus, a high strength polyethylene filament having a fineness of 1.5 dtex or less has not yet been obtained by the melt spinning.

One of commercially available polyethylene filaments made by the melt spinning has a tensile strength of about 10 cN/dtex at most, even though it is classified to high performance polyethylenes. At present, a polyethylene filament having a strength of as high as 15 cN/dtex or more has not yet been manufactured and put on the market.

The most effective solution to satisfy such a wide range of requirements is to decrease the fineness of a monofilament while maintaining the strength of the filament. However, the fineness of the monofilament of a polyethylene filament obtained by the melt spinning having a strength of as high as 15.0 cN/dtex or more is generally 2.0 to 5.0 dtex. Thus, it is impossible in a practical view to obtain as in the present invention not only a polyethylene filament which has a fineness of as low as 1.5 dtex or less, but also a polyethylene filament having a fineness of so far low as 1.0 dtex, at a productivity high enough for industrial production, even though such a filament can be present in a moment. Even if such a filament can be produced, the physical properties of the resultant filament markedly degrade and thus, this filament is insufficient for practical use. On the other hand, a high strength polyethylene filament having a fineness of as low as 0.5 dtex or less can be obtained by the gel spinning. However, such a high strength polyethylene filament with a lower fineness has problems in that there are many fusing points among each of the monofilaments thereof, and that it is very hard to obtain a desired uniform filament having a low fineness.

The present inventors assume that the following are the causes for the foregoing problems. In the melt spinning, the polymer has many intertwines of molecular chains therein, and therefore, the polymer extruded from a nozzle can not be sufficiently drawn. Further, it is practically impossible to use a polymer having a very high molecular weight of 1,000,000 or more in the melt spinning. Therefore, the resultant filament has a low strength even if achieving a low fineness. On the other hand, a high strength filament having a low fineness is made from a polyethylene having a molecular weight of as high as 1,000,000 or more, by the foregoing gel spinning, so as to decrease the number of the intertwines of molecular chains. This method has the following problems. The spinning and drawing tensions for obtaining a very fine filament becomes higher, and the use of a solvent for spinning and the drawing of a filament at a temperature higher than the melting point of the filament cause fusion in the filaments. Thus, a desired filament having an uniform fineness can not be obtained. Particularly in case where the cut fibers of such a filament is formed into non-woven cloth, the fused points of the filament degrades the physical properties of the resultant non-woven cloth. The present inventors have succeeded in obtaining a polyethylene filament having a very low fineness and a high strength which the gel spinning and the melt spinning could not achieve, and thus accomplished the present invention.

A high-strength polyethylene filament has advantages in a high strength and a high elastic modulus but has a disadvantage in low resistance to a compression stress because of its high crystallinity. In other words, the filament can well resist the tension in the filament axial direction, but it is destructed by a very low compression stress, if used in a situation under a compression stress.

As described above, a polyethylene filament with a high strength and a high elastic modulus made by the gel spinning is formed of crystals (having a high degree of order) from which defects are largely eliminated. Therefore, such a filament has very high physical properties but shows low resistance to a compression stress, as mentioned above. This fact is confirmed by an X-ray small angle scattering analysis in which no long period structure is observed.

Further, in case where an ultra-high molecular weight polyethylene having a molecular weight of 1,000,000 or more is used, it is possible to perform an ultra-drawing operation thereon. However, the structure of the resultant filament is so highly crystallized and ordered that no long period structure is observed in an X-ray small angle scattering pattern. Therefore, it is impossible to introduce a heterogeneous structure into the filament still maintaining the high physical properties.

The first object of the present invention is therefore to provide a high strength polyethylene filament which has a fineness of 1.5 dtex or less as a monofilament, a tensile strength of 15 cN/dtex or more, and a tensile elastic modulus of 300 cN/dtex, characterized in that the rate of dispersion-defective fibers cut from the filament is 2% or less.

Another object of the present invention is to provide a high strength polyethylene filament having a high resistance to compression which the conventional melt spinning and gel spinning are hard to impart the filament, a tensile strength of 15 cN/dtex or more, and a tensile elastic modulus of 300 cN/dtex or more, characterized in that a long period structure of 100 Å or less is observed in an X-ray small angle scattering pattern.

DISCLOSURE OF INVENTION

Figure 1:
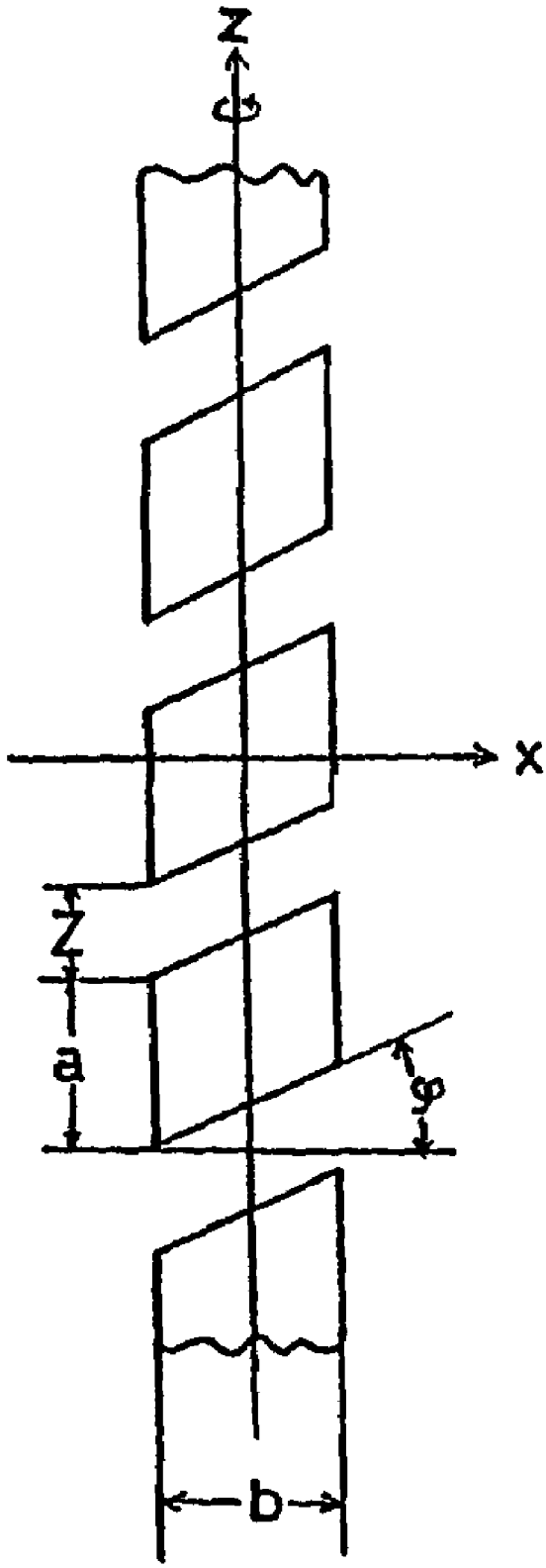
FIG. 1 shows a model structure which is analyzed from an X-ray small angle scattering pattern, based on a model of TsvÅnkin et al.

It is essential that the average fineness of monofilament of a high strength polyethylene filament according to the present invention should be 1.5 dtex or less, preferably 1.0 dtex or less, more preferably 0.5 dtex or less. When the average fineness exceeds 1.5 dtex, the effect to lower the fineness of the filament is insufficient. Thus, the resultant filament has a smaller difference in fineness from an existing monofilament having a fineness of 1.5 dtex or more, and thus, the superiority of this filament to the existing monofilament is low. For example, the stiffness of cloth made of a filament is examined. It is experimentally found that organoleptic evaluation reveals a critical point relative to the softness of cloth, at or around 0.5 dtex. In addition, when the average fineness exceeds 1.5 dtex, the effect to reduce the thickness of non-woven cloth made of such a filament becomes insufficient.

As mentioned above, a filament of the present invention has a very low average fineness. However, according to common knowledge, the physical properties of a filament having a very small average fineness are low. That is, a high strength polyethylene filament having a fineness of a monofilament of 1.5 dtex or less, a tensile strength of 15 cN/dtex, and a tensile elastic modulus of 300 cN/dtex or more has been made only by employing a complicated process such as gel spinning. However, the gel spinning has the foregoing problems: that is, to obtain a very fine filament, higher spinning and drawing tensions are required; and the use of a solvent for spinning and the drawing of a filament at a temperature higher than the melting point of the filament cause fusion in the filaments. For such disadvantages, a desired filament having an uniform fineness can not be obtained. Particularly where the cut fibers of such a filament are formed into non-woven cloth, the physical properties of the resultant non-woven cloth degrade because of the defectives such as the fused portions of the filament. In other words, it is impossible for any of the conventional methods to achieve a high strength polyethylene filament which has a low fineness, high strength and high elastic modulus, and which has no inter-filament fusion. However, as the result of the inventors' intensive efforts, for example, by employing the latter method, the present inventors have succeeded in obtaining a filament which has a strength and an elastic modulus equal to those of the conventional filaments and a high dispersibility, in spite of having a low fineness.

A high strength polyethylene filament of the present invention is characterized in that the tensile strength is 15 cN/dtex or more, and the tensile elastic modulus, 300 cN/dtex or more; and that a long period structure of 100 Å or less is observed on an X-ray small angle scattering pattern.

The present inventors have firstly investigated what form a polyethylene filament strongly desired so far has, that is, the form of such a polyethylene filament that has a high strength and a structure capable of relaxing a stress; and what is an ideal form therefor. As a result, they have proved that such a form of a highly ordered crystal that has an amorphous portion or a medium state of portion between a crystal and an amorphous substance, that is, a portion having an electron density lower than the crystal portion introduced thereinto is a model capable of most effectively improving the resistance to compression, while maintaining the physical properties such as strength, etc.

However, it is very hard to achieve such a model, using the foregoing conventional methods. This is because, in case where an amorphous portion or a medium portion between a crystal and an amorphous substance, in other words, a portion having an electron density lower than the crystalline portion (a portion having a low degree of order) is introduced into a filament, such a portion forms defectives, and thus impairs the physical properties of the filament such as strength and elastic modulus.

To overcome this problem, the present inventors have intensively studied and finally succeeded in obtaining a polyethylene filament having quite a novel form.

According to the present invention, one of the features of a model of the above form rests in that a long period structure of 100 Å or less, preferably 80 Å or less, more preferably 60 Å or less, is observed in an X-ray small angle scattering pattern. In case where no long period structure is observed in the X-ray small angle scattering pattern, it is undesirable because the structure of a filament has not an amorphous portion or a medium portion between a crystal and an amorphous substance, that is, a portion having an electron density lower than the crystalline portion (a crystalline portion having a low degree of order), which acts to relax a stress. If the long period structure exceeds 100 Å, the amorphous portion or the medium portion, even though present, results in a defective structure because the long period structure is larger than a threshold value (100 Å) Therefore, such a filament has a low tensile strength and a low elastic modulus, and thus can not satisfy the desired physical properties. Under such circumstances, the present inventors have discovered that an essential requirement of the model is that crystals composing a filament should be highly crystallized and ordered, and simultaneously include a small amount of a portion with a low degree of order therein. Such a filament shows an interference point pattern in an X-ray small angle scattering pattern, and is proved to have a very specific structural feature that its long period structure is of 100 Å or less. The structural features of such a filament can be quantitatively determined by analyzing an X-ray small angle scattering pattern by the method of YABUKI et al., as will be described later.

Hitherto, it has been very hard to make a high strength polyethylene filament of the present invention. That is, any of conventional polyethylene filaments which has a long period structure of 100 Å or less observed in an X-ray small angle scattering pattern has a very low strength and thus can not be practically used. To improve the tensile strength and the elastic modulus thereof, a specific spinning such as gel spinning or the like must be done, as mentioned above. However, for example, by employing the following method, the present inventors have made it possible to obtain a high strength polyethylene filament which, in spite of having a high strength, has high resistance to a compression stress, a high tensile strength of 15 cN/dtex or more and a tensile elastic modulus of 300 cN/dtex or more, and which also shows a long period structure of 100 Å or less in an X-ray small angle scattering pattern.

The process of producing a filament according to the present invention is described below. It is necessary to employ a novel and deliberate process as mentioned above. For example, the following process is recommended, however, this process should not be construed as limiting the scope of the present invention in any way. That is, to make a filament according to the present invention, it is preferable that the weight-average molecular weight of a polyethylene as a starting material is 60,000 to 600,000. Also, it is preferable that the polyethylene in the state of a filament has a weight-average molecular weight of 50,000 to 300,000, and that the ratio of the weight-average molecular weight to a number-average molecular weight (Mw/Mn) is 4.5 or less. It is more preferable that the weight-average molecular weight of a polyethylene as a starting material is 60,000 to 300,000; that the weight-average molecular weight of the polyethylene in the state of a filament is 50,000 to 200,000; and that the ratio of the weight-average molecular weight to a number-average molecular weight (Mw/Mn) is 4.0 or less. It is still more preferable that the weight-average molecular weight of a polyethylene as a starting material is 60,000 to 200,000; that the weight-average molecular weight of the polyethylene in the state of a filament is 0.50,000 to 150,000; and that the ratio of the weight-average molecular weight to a number-average molecular weight (Mw/Mn) is 3.0 or less.

Polyethylene referred to in the text of the present invention is a polyethylene of which the repeating unit is substantially ethylene, or it may be a copolymer of an ethylene with a small amount of other monomer such as α-olefin, acrylic acid or its derivative, methacrylic acid or its derivative, vinyl silane or its derivative, or the like, or a blend of the above copolymer and a copolymer or the above copolymer and the ethylene homopolymer, or a blend with the ethylene homopolymer and the α-olefin. Particularly, it is preferable to use a copolymer with α-olefin such as propyrene, butene-1 or the like to thereby introduce some branches of short chains or long chains into a polyethylene. This is preferable because the resultant filament is imparted with stability in the step of spinning and drawing a filament of the present invention. However, an excessive amount of a component other than ethylene hinders the drawing of a filament. Therefore, in order to obtain a filament having a high strength and a high elastic modulus, the amount of such a component is 0.2 mol % or less, preferably 0.1 mol % or less in terms of mol. It is needless to say that a polyethylene of the present invention may be a homopolymer of ethylene alone. In addition, the polymer may be intentionally deteriorated in the step of melt extrusion or spinning so as to control the molecular weight distribution of the polyethylene in the state of a filament to the above specified values; or otherwise, a polyethylene which is polymerized in the presence of, for example, a metallocene catalyst having a narrow molecular weight distribution may be used.

When the weight-average molecular weight of a polyethylene as a starting material is less than 60,000, such a material is easy to be melt-molded, but the resultant filament is poor in strength because of the low molecular weight. On the other hand, when a polyethylene as a starting material has a weight-average molecular weight of more than 600,000 or more, the melt viscosity of such a high molecular weight polyethylene becomes very high, and therefore, the melt molding thereof becomes very hard. In addition, when the ratio of the weight-average molecular weight to the number-average molecular weight of the polyethylene in the state of a filament is 4.5 or more, this polyethylene filament is lower in the largest draw ratio in drawing and also lower in strength, as compared with a case using a polymer having the same weight-average molecular weight. The reasons therefor are assumed that the molecular chain with long relaxing time can not be fully drawn in the drawing step and finally breaks, and that its wider molecular weight distribution permits the amount of a component with a lower molecular weight to increase to thereby increase the number of the molecular ends, which lowers the strength of the resultant filament.

Next, the methods recommended for the spinning step and the drawing step are separately described about the following two productions of high strength polyethylene filaments. That is, one is the production of a high strength polyethylene filament characterized in that the rate of dispersion-defective fibers cut from the polyethylene filament is 2.0% or less, and the other is the production of a high strength polyethylene filament in which the long period structure of 100 Å or less is observed in an X-ray small angle scattering pattern. Both of the processes may be separately employed, or the spinning method and the drawing method of the other process may be employed for producing one of the filaments.

Firstly, the former process will be described. Polyethylene is melt-extruded by an extruder and is quantitatively discharged through a spinneret with a gear pump. The thread-like polyethylene extruded is allowed to pass through a thermally insulating cylinder maintained at a constant temperature, and then quenched and drawn at a predetermined speed. Preferably, the thermally insulating section is maintained at a temperature which is higher than the crystal-dispersing temperature of the filament and lower than the melting point of the same filament. More preferably, the maintained temperature is at least 10° C. lower than the melting point of the filament, and at least 10° C. higher than the crystal-dispersing temperature of the filament. A gas is usually used for quenching the filament, and of course, a liquid may be used in order to improve the quenching efficiency. Preferably, an air is used in case of a gas, and water is used in case of a liquid.

It becomes possible to produce a high strength polyethylene filament by drawing the above threadlike polyethylene, if needed, in multi-stages. In this regard, the threadlike polyethylene spun may be continuously drawn without a step of winging up such a threadlike polyethylene, or the spun threadlike polyethylene may be once wound up and then drawn.

In the present invention, it is important that a threadlike polyethylene discharged from the spinneret of a nozzle is, first, thermally maintained in the thermally insulating section, at a temperature higher than the crystal-dispersing temperature of the filament and lower than the melting point of the filament, and then quenched immediately after this step. By doing so, the spinning can be carried out at a higher speed, and the non-drawn filament which will be able to be drawn up to a low fineness can be obtained, and further, it becomes possible to prevent the fusion between each of the filaments, if an increased number of the filaments are made.

Next, the latter process will be described.

Polyethylene mentioned above is melt-extruded by an extruder, quantitatively discharged through a spinneret with a gear pump. The resultant threadlike polyethylene was then quenched with a cooled air, and drawn at a predetermined speed. In the drawing step, it is important that the threadlike polyethylene is drawn quickly enough. In other words, it is important that the ratio of the discharge linear speed to the winding speed is 100 or more, preferably 150 or more, more preferably 200 or more. This ratio can be calculated from the diameter of the mouthpiece, the discharge amount from a single hole, the polymer density, and the winding speed.

Next, it is recommended that the threadlike polyethylene is drawn in a single stage or in multi-stages by the following method. In this step, the threadlike polyethylene spun may be continuously drawn without a step of winding up, or it may be once wound up and then drawn. The drawing operation is carried out, using a plurality of godet rollers. In case of multi-stage drawing, the number of godet rollers may be increased as required. It is possible to set each of the godet rollers at an optional temperature, and also, it is possible to optionally arrange a slit heater capable of adjusting the temperature and the length, between each of the godet rollers. It is desirable that the threadlike polyethylene is drawn at a draw ratio (DR 1) of 1.5 to 5.0, preferably 2.0 to 3.0, in the first stage. Necking drawing is carried out between the second godet roller and the third godet roller. The importance for this operation is that the threadlike polyethylene should be relax-drawn at a draw ratio of 0.90 to 0.99 between the third godet roller and the fourth godet roller (DR 2) immediately after the neck drawing. If the threadlike polyethylene is excessively relaxed in this step, the physical properties of the resultant filament becomes poor. After that, the threadlike polyethylene is drawn between the fourth godet roller and the fifth godet roller (DR 3). A slit heater may be arranged between the fourth godet roller and the fifth godet roller. If further drawing (DR 4) is carried out, the sixth godet roller is used. In this case, a slit heater may be arranged between the fifth godet roller and the sixth godet roller. After that, the resultant filament is relaxed by several percents, and is finally wound up onto a winder. In case where further multi-stage drawing is needed, further godet rollers and further slit heaters may be arranged.

Hereinafter, the method of measurement and the measuring conditions for finding the characteristic values according to the present invention will be explained below.

(Strength and Elastic Modulus)

The tensile strength and the elastic modulus of a sample, of the present invention, with a length of 200 mm (the distance between each of chucks) were measured as follows. The sample was drawn at a drawing speed of 100%/min., using "Tensilone" (Orientic Co., Ltd.). A strain-stress curve was recorded under an atmosphere of a temperature of 20° C. and a relative humidity of, 65%. The strength of the sample (cN/dtex) was calculated from a stress at the breaking point of the curve, and the elastic modulus (cN/dtex) was calculated from a tangent line which shows the largest gradient at or around the origin of the curve. The respective values were measured 10 times, and the 10 measured values were averaged.

(Weight-Average Molecular Weight Mw, Number-Average Molecular Weight Mn, and Ratio of Mw/Mn)

The values of the weight-average molecular weight Mw, the number-average molecular weight Mn, and the ratio of Mw/Mn were measured by gel permeation chromatograph (GPC). As the apparatus for GPC, GPC 150C ALC/GPC (manufactured by WAters) equipped with one column (GPC UT802.5 manufactured by SHODEX) and two columns (UT806M) was used. As a solvent for use in measurement, o-dichlorobenzene was used, and the temperature of the columns were set at 145° C. The concentration of the sample was 1.0 mg/ml, and it was measured by injecting 200 μl of the sample. The calibration curve of the molecular weight was found by the universal calibration method, using a polystyrene sample having a known molecular weight.

(Dispersibility Test)

About 0.02 g of fibers with lengths of 10 mm cut from a filament, previously degreased, were weighed and put into distilled water (300 ml) and stirred at 60 rpm for one min. with a stirrer. After that, the fibers of the filament were collected by filtration using a metallic filter with #300 mesh and dried at room temperature in an air for 24 hours. After dried, agglomerations of two or more fibers fused were picked up and weighed while the fibers of the filament were observed with a magnifier. After that, the content of dispersion-defective fibers was calculated. The test was conducted ten times (n=10) and the average of the results of ten times of the tests was used for evaluation. The rate of the dispersion-defective fibers was calculated by the following equation.

The rate of the dispersion-defective fibers(%)=(the weight of the dispersion-defective fibers)×100÷(the weight of the fibers cut from the filament)

(Measurement by X-Ray Small Angle Scattering Analysis)

An X-ray small angle scattering analysis was conducted by the following method. X rays used for measurement were emitted by using Rotar Flex RU-300 manufactured by RIGAKU Co., Ltd. Using copper paired cathodes as a target, an operation was carried out at a fine focus of an output of 36 kV×30 mÅ. As the optical system, a point-convergent camera was used. X rays were monochromed through a nickel filter. As the detector, an imaging plate (FDL UR-V) manufactured by Fuji Shashin Film Co., Ltd. was used. The distance between the sample and the detector was appropriately selected from a range of 200 mm to 350 mm. To prevent interference background scattering by an air or the like, a helium gas was charged in a space between the sample and the detector. The exposure time was from 2 hours to 3 hours. Digital Micrography (FDL5000) manufactured by Fuji Shashin Film Co., Ltd. was used to read the scattering intensity signals recorded on the imaging plate. From the resultant data, the long-form period of the sample was determined. The width of a crystal composing a fibril vertical to the meridian, and the rate of a portion with a high degree of order (crystal) in the repeating unit of the long period structure were determined by the method of YABUKI et al. (TEXTILE RESEARCH JOURNAL, vol. 56, pp 41–48 (1986)) which applied the method of Tsvankins et al. (Kolloid-Z.u.Z, polymere, vol. 250, pp 518–529 (1972)).

According to the method of YABUKI et al., the equation of determining the intensity of X-ray small angle scattering, taken into account the axial symmetry, is expressed by the equation 1, wherein J is a function of diffraction; A, the magnitude in the direction of the meridian in a region having a high electron density; b, the width of the region; f, the thickness thereof; Z, the magnitude in the direction of the meridian in a region having a low electron density; β is equal to Δ/A; Δ is the thickness of the interface layer between the region having the high electron density and the region having the low electron density; and h, k and l are the spatial axes in the reciprocal lattice which correspond to the coordinates x, y and z in an actual space (see FIG. 1, in which Ψ is an angle of inclination). An image of X-ray small angle scattering was calculated by the equation 1, and the values of the parameters A, b and Z were determined so as to reproduce an image of an actually found X-ray small angle scattering pattern. The rate (q) of the portion having the high degree of order (crystal) in the repeating unit of the long period structure was calculated by the equation 2.

$$I(r,l) = J\frac{\sin^2(\beta y/2)}{(\beta y/2)^2}\frac{\sin^2(\pi la)}{(\pi la)^2}\frac{1}{\pi}\times\int_0^{\pi}\frac{\sin^2\{\pi(r\cos\theta - lt)b\}}{\{\pi(r\cos\theta - lt)b\}^2}\frac{\sin^2(\pi fr\sin\theta)}{(\pi fr\sin\theta)^2}d\theta \quad \text{Equation 1}$$

$$q = A/(A+Z)\times 100 \quad \text{Equation 2}$$

BEST MODES FOR CARRYING OUT THE INVENTION

EXAMPLE 1

A highly dense polyethylene which had a weight-average molecular weight of 115,000 and a ratio of the weight-average molecular weight to a number-average molecular weight of 2.3 was extruded through a spinneret having 10 holes with diameters of 0.8 mm so that the polyethylene could be discharged at 290° C. and at a rate of 0.5 g/min. per hole. The threadlike polyethylene extruded was allowed to pass through a thermally insulating cylinder with a length of 15 cm heated at 110° C. and then quenched in a cooling bath maintained at 20° C., and wound up at a speed of 300 m/min. This non-drawn filament was heated to 100° C. and fed at a speed of 10 m/min. so as to be drawn to a length twice longer. After that, the filament was further heated to 130° C. and was drawn to a length seven times longer. The physical properties of the resultant drawn filament are shown in Table 1.

EXAMPLE 2

The experiment was conducted substantially in the same manner as in Example 1, except that the winding rate was changed to 500 m/min., and that the draw ratio for drawing at the second stage was changed to 4.1. The physical properties of the resultant filament are shown in Table 1.

EXAMPLE 3

The experiment was conducted substantially in the same manner as in Example 1, except that the non-drawn filament was heated to 100° C. and fed at a speed of 10 m/min. so as to be drawn to a length twice longer, and then, was further heated to 130° C. and was drawn to a length 14 times longer. The physical properties of the resultant filament are shown in Table 1.

EXAMPLE 4

The experiment was conducted substantially in the same manner as in Example 1, except that the non-drawn filament was heated to 100° C. and fed at a speed of 10 m/min. so as to be drawn to a length twice longer, and then, was further heated to 130° C. and was drawn to a length 20 times longer. The physical properties of the resultant filament are shown in Table 1.

EXAMPLE 5

The non-drawn filament was obtained substantially in the same manner as in Example 1, except that a highly dense polyethylene having a weight-average molecular weight of 152,000 and a ratio of the weight-average molecular weight to a number-average molecular weight of 2.4 was extruded at 300° C. through a spinneret having 10 holes with diameters of 0.9 mm so that the polyethylene could be discharged at 0.5 g/min. per hole.

The non-drawn filament was heated to 100° C. and fed at a speed of 10 m/min. so as to be drawn to a length twice longer, and then, was further heated to 135° C. and drawn to a length 8.0 times longer. The physical properties of the resultant filament are shown in Table 1.

COMPARATIVE EXAMPLE 1

A slurry-like mixture of an ultra-high molecular weight polyethylene having a weight-average molecular weight of 3,200,000 and a ratio of the weight-average molecular weight to a number-average molecular weight of 6.3 (10 wt. %) and decahydronaphthalene (90 wt. %) was dispersed and dissolved with a screw type kneader set at 230° C., and was fed to a mouthpiece which had 2,000 holes with diameters of 0.2 mm and was set at 170° C., using a weighing pump, so that the polyethylene could be discharged at 0.08 g/min. per hole. A nitrogen gas adjusted to 100° C. was fed at a rate of 1.2 m/min. from a slit-like gas-feeding orifice arranged just below a nozzle, and such a nitrogen gas was blown against the filament as uniformly as possible so as to evaporate off decalin from the surface of the non-drawn filament. Immediately after that, the filament was substantially cooled in an air flow set at 30° C. The non-drawn filament cooled was drawn at a rate of 50 m/min. with Nelson-like-arranged rollers which were set on the side of downstream from the nozzle. At this stage, the solvent contained in the filament was reduced to about a half of the original weight. The filament was sequentially drawn to a length 4.6 time longer, in an oven set at 149° C. The resultant filament was uniform and without any breakage. The physical properties of the resultant filament are shown in Table 2.

COMPARATIVE EXAMPLE 2

A highly dense polyethylene having a weight-average molecular weight of 125,000 and a ratio of the weight-average molecular weight to a number-average molecular weight of 4.9 was extruded at 300° C. through a spinneret which had 10 holes with diameters of 0.8 mm, so that the polyethylene could be discharged at 0.6 g/min. per hole. The extruded threadlike polyethylene was allowed to pass through a hot tube with a length of 60 cm, heated at 270° C., and then was quenched with an air maintained at 20° C., and wound up at a rate of 90 m/min. The resultant non-drawn filament was heated to 100° C. and fed at a rate of 10 m/min. so as to be drawn to a length twice longer. It was then further heated to 130° C. and drawn to a length 15 times longer. The physical properties of the resultant filament are shown in Table 2.

COMPARATIVE EXAMPLE 3

The non-drawn filament of Comparative Example 2 was heated to 100° C. and fed at a rate of 10 m/min. so as to be drawn to a length twice longer. It was then further heated to 130° C. and drawn to a length 16 times longer. However, the filament was broken and no drawn filament was obtained.

COMPARATIVE EXAMPLE 4

A highly dense polyethylene having a weight-average molecular weight of 125,000 and a ratio of the weight-average molecular weight to a number-average molecular weight of 6.7 was spun in the same manner as in Example 1. The resultant non-drawn filament was heated to 100° C. and fed at a rate of 10 m/min. so as to be drawn to a length twice longer. It was then further heated to 130° C. and drawn to a length 7 times longer. The physical properties of the resultant filament are shown in Table 2.

EXAMPLE 6

A highly dense polyethylene having a weight-average molecular weight of 115,000 and a ratio of the weight-average molecular weight to a number-average molecular weight of 2.3 was extruded at 290° C. through a spinneret which had 10 holes with diameters of 0.8 mm, so that the polyethylene could be discharged at 0.5 g/min. per hole. The extruded threadlike polyethylene was quenched with a cooled air of 25° C., and wound up at a rate of 300 m/min. The resultant non-drawn filament was set on a drawing machine and drawn at a rate of 5 m/min. at a total draw ratio of 9.0. The physical properties of the resultant filament are shown in Table 3.

EXAMPLE 7

The experiment was conducted substantially in the same manner as in Example 6, except that the total draw ratio was changed to 15.0. The physical properties of the resultant filament are shown in Table 3.

EXAMPLE 8

The experiment was conducted substantially in the same manner as in Example 1, except that a spinneret having 10 holes with diameters of 1.2 mm was used, that the amount of the polyethylene discharged from one hole was changed to 1.5 g/min., and that the total draw ratio was changed to 12.0. The physical properties of the resultant filament are shown in Table 3.

EXAMPLE 9

The experiment was conducted substantially in the same manner as in Example 3, except that the total draw ratio was changed to 20.0. The physical properties of the resultant filament are shown in Table 3.

EXAMPLE 10

A non-drawn filament was obtained substantially in the same manner as in Example 1, except that a highly dense polyethylene having a weight-average molecular weight of 152,000 and a ratio of the weight-average molecular weight to a number-average molecular weight of 2.4 was extruded at 300° C. through a spinneret which had 10 holes with diameters of 1.2 mm, so that the polyethylene could be discharged at 0.5 g/min. per hole. The non-drawn filament was set on a drawing machine and drawn at a rate of 5 m/min. at a total draw ratio of 17.0. The physical properties of the resultant filament are shown in Table 3.

COMPARATIVE EXAMPLE 5

A slurry-like mixture of an ultra-high molecular weight polyethylene having a weight-average molecular weight of 3,200,000 and a ratio of the weight-average molecular weight to a number-average molecular weight of 6.3 (10 wt. %) and decahydronaphthalene (90 wt. %) was dispersed and dissolved with a screw type kneader set at 230° C., and was fed to a mouthpiece which had 500 holes with diameters of 0.9 mm and was set at 170° C., using a weighing pump, so that the polyethylene could be discharged at 1.2 g/min. per hole. A nitrogen gas adjusted to 100° C. was fed at a rate of 1.2 m/min. from a slit-like gas-feeding orifice arranged just below a nozzle, and such a nitrogen gas was blown against the filament as uniformly as possible so as to evaporate off decalin from the surface of the non-drawn filament. The non-drawn filament was drawn at a rate of 80 m/min. with Nelson-like-arranged rollers which were set on the side of downstream from the nozzle. At this stage, the solvent contained in the filament was reduced to about 20 wt. % of the original weight. The resultant filament was sequentially drawn to a length 3.4 time longer, in an oven set at 125° C. The filament was sequentially drawn to a length 4.0 times longer, in an oven heated to 149° C. The resultant filament was uniform and without any breakage. The physical properties of the resultant filament are shown in Table 4.

COMPARATIVE EXAMPLE 6

A highly dense polyethylene having a weight-average molecular weight of 125,000 and a ratio of the weight-average molecular weight to a number-average molecular weight of 4.9 was extruded at 300° C. through a spinneret which had 10 holes with diameters of 0.8 mm so that the polyethylene could be discharged at 0.5 g/min. per hole. The extruded threadlike polyethylene was allowed to pass through a hot tube with a length of 60 cm, heated at 270° C., and then was quenched with an air maintained at 20° C., and wound up at a rate of 90 m/min. The resultant non-drawn filament was heated to 100° C. and fed at a rate of 10 m/min. so as to be drawn to a length twice longer. It was then further heated to 130° C. and drawn to a length 15 times longer. The physical properties of the resultant filament are shown in Table 4.

COMPARATIVE EXAMPLE 7

The non-drawn filament of Comparative Example 6 was heated to 100° C. and fed at a rate of 10 m/min. so as to be drawn to a length twice longer. It was then further heated to 130° C. and drawn to a length 16 times longer. However, this filament was broken and no drawn filament was obtained.

COMPARATIVE EXAMPLE 8

A highly dense polyethylene having a weight-average molecular weight of 125,000 and a ratio of the weight-average molecular weight to a number-average molecular weight of 6.7 was spun in the same manner as in Example 6. The resultant non-drawn filament was heated to 100° C. and fed at a rate of 10 m/min. so as to be drawn to a length twice longer. It was then further heated to 130° C. and drawn to a length 7 times longer. The physical properties of the resultant filament are shown in Table 4.

COMPARATIVE EXAMPLE 9

The tensile strength, the elastic modulus, and the long-form period in an X-ray small angle scattering pattern, of a commercially available polyethylene monofilament were determined. The results are shown in Table 4.

COMPARATIVE EXAMPLE 10

The tensile strength, the elastic modulus, and the long-form period in an X-ray small angle scattering pattern, of a commercially available polyethylene multifilament were determined in the same manner as in Comparative Example 9. The results are shown in Table 4.

COMPARATIVE EXAMPLE 11

A non-drawn filament was obtained substantially in the same manner as in Example 6, except that the spinning rate was changed to 60 m/min. The resultant non-drawn filament was heated to 80° C. and fed at a rate of 5 m/min. so as to be drawn to a length twice longer. It was then further heated to 130° C. and drawn to a length 11 times longer. The physical properties of the resultant filament are shown in Table 4.

TABLE 1

| | Ex. 1 | Ex. 2 | Ex. 3 | Ex. 4 | Ex. 5 |
|---|---|---|---|---|---|
| Weight-average molecular weight (polymer) | 115,000 | 115,000 | 115,000 | 115,000 | 152,000 |
| Mw/Mn (polymer) | 2.3 | 2.3 | 2.3 | 2.3 | 2.4 |
| Weight-average molecular weight (filament) | 105,000 | 105,000 | 105,000 | 105,000 | 141,000 |
| Mw/Mn (filament) | 2.2 | 2.2 | 2.2 | 2.2 | 2.3 |
| Fineness (dtex) | 11.0 | 11.0 | 6.0 | 4.0 | 10 |
| Fineness of monofilament (dtex) | 1.1 | 1.1 | 0.6 | 0.4 | 1.0 |
| Strength (cN/dtex) | 18.0 | 17.6 | 18.8 | 19.6 | 19.6 |
| Elastic modulus (cN/dtex) | 810 | 790 | 880 | 920 | 825 |
| Rate of dispersion-defective fibers (%) | 0.1 or less | 0.1 or less | 0.1 or less | 0.1 or less | 0.1 or less |

TABLE 2

| | Comp. Ex 1 | Comp. Ex 2 | Comp. Ex 4 |
|---|---|---|---|
| Weight-average molecular weight (polymer) | 3,200,000 | 125,000 | 125,000 |
| Mw/Mn (polymer) | 6.3 | 4.9 | 6.5 |
| Weight-average molecular weight (filament) | 2,500,000 | 111,000 | 114,500 |
| Mw/Mn (filament) | 5.1 | 4.7 | 6.0 |
| Fineness (dtex) | 209 | 22 | 12 |
| Fineness of monofilament (dtex) | 0.1 | 2.2 | 1.2 |
| Strength (cN/dtex) | 27.5 | 16.1 | 13.0 |
| Elastic modulus (cN/dtex) | 921 | 675 | 268 |
| Rate of dispersion-defective fibers (%) | 12.1 | 0.1 or less | 0.1 or less |

TABLE 3

| | Ex. 6 | Ex. 7 | Ex. 8 | Ex. 9 | Ex. 10 |
|---|---|---|---|---|---|
| Weight-average molecular, weight (polymer) | 115,000 | 115,000 | 115,000 | 115,000 | 152,000 |
| Mw/Mn (polymer) | 2.3 | 2.3 | 2.3 | 2.3 | 2.4 |
| GR 2 speed (m/min.)/temperature (° C.) | 5.1/80 | 5.1/80 | 5.1/80 | 5.1/80 | 5.1/80 |
| GR 3 speed (m/min.)/temperature (° C.) | 10/100 | 10/100 | 10/100 | 10/100 | 10/100 |
| GR 4 speed (m/min.)/temperature (° C.) | 9.5/120 | 9.5/120 | 9.5/120 | 9.5/120 | 9.5/120 |
| GR 5 speed (m/min.)/temperature (° C.) | 31.5/120 | 42/120 | 52.5/120 | 78.8/120 | 78.8/120 |
| GR 6 speed (m/min.) | 30 | 40 | 50 | 75 | 75 |
| Temperature (° C.) of slit heater | 130 | 130 | 130 | 130 | 135 |
| Draw ratio ratio (–) | 9.0 | 15.0 | 12.0 | 20.0 | 17.0 |
| Weight-average molecular weight (filament) | 105,000 | 105,000 | 105,000 | 105,000 | 141,000 |
| Mw/Mn (filament) | 2.2 | 2.2 | 2.2 | 2.2 | 2.3 |
| Fineness (dtex) | 18.5 | 11.1 | 41.7 | 22.2 | 9.8 |
| Strength (cN/dtex) | 16.4 | 17.4 | 16.5 | 18.8 | 20.1 |
| Elastic modulus (cN/dtex) | 560 | 755 | 550 | 820 | 840 |
| Long-form period (Å) | 49 | 48 | 48 | 47 | 48 |
| b (Å) | 188 | 200 | 190 | 200 | 210 |
| q (%) | 80 | 83 | 80 | 82 | 85 |

TABLE 4

| | Comp. Ex. 5 | Comp. Ex. 6 | Comp. Ex. 7 | Comp. Ex. 8 | Comp. Ex. 9 | Comp. Ex. 10 |
|---|---|---|---|---|---|---|
| Weight-average molecular weight (polymer) | 3,200,000 | 125,000 | 125,000 | — | — | 115,000 |
| Mw/Mn (polymer) | 6.3 | 4.9 | 4.9 | | | 2.3 |
| Draw ratio (–) | 13.5 | 30 | 14 | — | — | 22 |
| Weight-average molecular weight (filament) | 2,500,000 | 111,000 | 114,500 | — | — | 105,000 |
| Mw/Mn (filament) | 5.1 | 4.7 | 6.0 | — | — | 2.2 |
| Fineness (dtex) | 557 | 22 | 12 | 446 | 425 | 38 |
| Strength (cN/dtex) | 26.7 | 16.1 | 13 | 4.5 | 7.1 | 13.4 |
| Elastic modulus (cN/dtex) | 814 | 675 | 268 | 25.1 | 129.0 | 375 |
| Long period (Å) | not observed | 210 | 185 | 185 | 190 | 240 |
| b (Å) | — | 115 | 100 | 100 | 102 | 110 |
| q (%) | — | 67 | 60 | 46 | 51 | 62 |

INDUSTRIAL APPLICABILITY

There can be provided a polyethylene filament which has an excellent dispersibility, a lower fineness, a higher strength and a higher elastic modulus, than the conventional polyethylene filaments, and a polyethylene filament which has so high a strength and so high a resistance to a compression stress as to be applicable in a wide range of industrial fields.

The invention claimed is:

1. A high strength polyethylene filament, wherein said filament has a fineness of 1.5 dtex or less as a monofilament, a tensile strength of 15 cN/dtex or more and a tensile elastic modulus of 300 cNldtex or more, the rate of dispersion-defective fibers cut from the filament is 2.0% or less, the weight-average molecular weight (Mw) in the state of the filament is 50,000 to 150,000, and the ratio (Mw/Mn) of the weight-average molecular weight (Mw) to a number-average molecular weight (Mn) is 3.0 or less.

2. A high strength polyethylene filament according to claim 1, wherein the fineness of the monofilament is 1.0 dtex or less.

3. A high strength polyethylene filament according to claim 1, wherein the fineness of the monofilament is 0.5 dtex or less.

4. A high strength polyethylene filament according to claim 1, 2 or 3, wherein the rate of dispersion-defective fibers is 1.0% or less.

* * * * *